US007479174B2

(12) United States Patent
Shimizu et al.

(10) Patent No.: US 7,479,174 B2
(45) Date of Patent: Jan. 20, 2009

(54) INNER ROTOR AND OUTER ROTOR OF INTERNAL GEAR PUMP

(75) Inventors: Teruo Shimizu, Niigata (JP); Tuneo Maruyama, Niigata (JP)

(73) Assignee: Mitsubishi Materials PMG Corporation, Niigata (JP)

( * ) Notice: Subject to any disclaimer, the term of this patent is extended or adjusted under 35 U.S.C. 154(b) by 26 days.

(21) Appl. No.: 10/599,508

(22) PCT Filed: Mar. 29, 2005

(86) PCT No.: PCT/JP2005/005927

§ 371 (c)(1), (2), (4) Date: Dec. 21, 2006

(87) PCT Pub. No.: WO2005/095801

PCT Pub. Date: Oct. 13, 2005

(65) Prior Publication Data

US 2007/0199408 A1 Aug. 30, 2007

(30) Foreign Application Priority Data

Mar. 31, 2004 (JP) ..... 2004-107651

(51) Int. Cl.
*B22F 3/00* (2006.01)

(52) U.S. Cl. ..... 75/247; 418/179

(58) Field of Classification Search ..... 75/247; 418/179

See application file for complete search history.

(56) References Cited

U.S. PATENT DOCUMENTS

| | | | | |
|---|---|---|---|---|
| 2,831,243 | A * | 4/1958 | Thomson | 75/233 |
| 4,505,987 | A * | 3/1985 | Yamada et al. | 428/553 |
| 4,681,629 | A * | 7/1987 | Reinshagen | 75/246 |
| 5,199,971 | A * | 4/1993 | Akechi | 75/249 |
| 5,714,700 | A * | 2/1998 | Nishida et al. | 75/231 |
| 5,879,476 | A | 3/1999 | Narushima et al. | |
| 6,089,843 | A * | 7/2000 | Kondoh | 418/179 |
| 6,524,365 | B1 * | 2/2003 | Kanezaki et al. | 75/243 |
| 6,682,322 | B2 | 1/2004 | Funakoshi et al. | |
| 6,793,393 | B2 * | 9/2004 | Noboru et al. | 384/42 |
| 2001/0021353 | A1 * | 9/2001 | Sakai et al. | 420/470 |
| 2003/0143096 | A1 | 7/2003 | Shimizu et al. | |

FOREIGN PATENT DOCUMENTS

| | | |
|---|---|---|
| JP | S56-136947 | 10/1981 |
| JP | H8-144964 | 6/1996 |
| JP | H9-111375 | 4/1997 |
| JP | 2003-221605 | 8/2003 |

* cited by examiner

*Primary Examiner*—Roy King
*Assistant Examiner*—Ngoclan T Mai
(74) *Attorney, Agent, or Firm*—Darby & Darby P.C.

(57) ABSTRACT

An inner rotor having excellent corrosion resistance, which has an outer gear serving as a component of an internal gear pump, and an outer rotor having excellent corrosion resistance, which has an inner gear engaging with the outer gear. The inner rotor and outer rotor of are made of Cu—Ni-based sintered copper alloy that contains 12 to 50% by mass of Ni, 5 to 20% by mass of Sn, 0.5 to 5% by mass of C, and if necessary, further contains 5 to 20% by mass of Zn, 0.1 to 0.9% by mass of P, and a balance being Cu and inevitable impurities.

4 Claims, No Drawings

INNER ROTOR AND OUTER ROTOR OF INTERNAL GEAR PUMP

CROSS REFERENCE TO PRIOR APPLICATION

This is a U.S. national phase application under 35 U.S.C. §371 of International Application No. PCT/JP2005/005927 filed Mar. 29, 2005 and claims the benefit of Japanese Application No. 2004-107651, filed Mar. 31, 2004, both of which are incorporated by reference herein. The International Application was published in Japanese on Oct. 13, 2005 as International Publication No. WO 2005/095801 under PCT Article 21(2).

BACKGROUND OF THE INVENTION

1. Field of the Invention

The present invention relates to an inner rotor having excellent corrosion resistance, which has an outer gear serving as a component of an internal gear pump, and an outer rotor having excellent corrosion resistance, which has an inner gear engaging with the outer gear. In particular, the present invention relates to an inner rotor and an outer rotor that are made of Cu—Ni-based sintered copper alloy.

2. Description of the Related Art

In general, it has been known that an internal gear pump includes an inner rotor having an outer gear and an outer rotor having an inner gear which engages with the outer gear, and the inner rotor and outer rotor are incorporated in the internal gear pump. Furthermore, it has been known that the internal gear pump has a structure for sucking fuel from a suction port so as to discharge from a discharging port by increasing or decreasing the capacity of a pump chamber formed between contacting portions of the respective rotors by rotation of the outer rotor, which engages with the inner rotor, rotating in the same direction as the inner rotor by driving the inner rotor by a motor.

Since the structure of the internal gear pump is relatively simple and pump efficiency thereof is high, the internal gear pump has been employed in a mechanism for supplying fuel such as gasoline or light diesel oil to the engine of an automobile or the like. The inner rotor and outer rotor configuring the internal gear pump for supplying fuel is generally made of an iron-based sintered alloy, (for example, see JP-A-8-144964).

However, often, sulfur, a compound thereof, or an organic acid, such as formic acid or acetic acid, in addition to alcohol or water, may be further mixed into the diesel oil or foreign gasoline. If using the above-described inferior gasoline is used, the inner rotor and outer rotor made of iron-based sintered alloy excessively corrode. If the inner rotor and outer rotor become corroded, a contacting portion between the inner rotor and outer rotor and a junction portion between the respective rotors and a housing become worn away, so that the liquid-tight property of the pump chamber cannot be maintained. For this reason, the following problem occurs when gasoline leaks to the neighboring low pressure pump from a pump chamber, which should discharge gasoline at the high-pressure state, through the worn portion, which reduces the pump efficiency, causing the life span to be short. In order to prevent corrosion of the inner rotor and outer rotor made of the above-described related art iron-based sintered alloy, the inner rotor and outer rotor thickly plated with nickel has been proposed. The inner rotor and outer rotor have a corrosion resistance to some extent due to the thick plating of nickel, but the operation for thickly plating the rotors with nickel increases the cost. Accordingly, it is not possible to satisfy the demand for reduction in cost.

SUMMARY OF THE INVENTION

Accordingly, the inventors have done research to provide an internal gear pump which can suppress the power consumption of a motor for driving a pump by lowering the sliding resistance between an inner rotor and outer rotor and the sliding resistance between the respective rotors and a housing, while decreasing the corrosion of an inner periphery surface of the inner rotor and an outer periphery surface of the outer rotor even though using inferior gasoline and can be used for a long time.

The results obtained by the research are as follows: an inner rotor and an outer rotor made of Cu—Ni-based sintered copper alloy containing, (hereinafter, % means % by mass), 12 to 50% of Ni, 5 to 20% of Sn, 0.5 to 5% of C, and the balance being Cu and inevitable impurities; and an inner rotor and an outer rotor made of Cu—Ni-based sintered copper alloy having a component composition of 5 to 20% of Zn and 0.1 to 0.91 of P further added to the above-described Cu—Ni-based sintered copper alloy. As compared to the related art iron-based sintered alloy, the former Cu—Ni-based sintered copper alloy has excellent corrosion resistance to the inferior gasoline and has no need to conduct nickel plating, and the latter Cu—Ni-based sintered copper alloy is better improved in strength and hardness.

The invention based on the above-described research results is as follows:

(1) An inner rotor of an internal gear pump made of Cu—Ni-based sintered copper alloy having a component composition of 12 to 50% by mass of Ni, 5 to 20% by mass of Sn, 0.5 to 5% by mass of C, and the balance being Cu and inevitable impurities.

(2) An outer rotor of an internal gear pump made of Cu—Ni-based sintered copper alloy having a component composition of 12 to 50% by mass of Ni, 5 to 20% by mass of Sn, 0.5 to 5% by mass of C, and the balance being Cu and inevitable impurities.

(3) An inner rotor of an internal gear pump made of Cu—Ni-based sintered copper alloy having a component composition of 12 to 50% by mass of Ni, 5 to 20% by mass of Sn, 5 to 20% by mass of Zn, 0.5 to 5% by mass of C, 0.1 to 0.9% by mass of P, and the balance being Cu and inevitable impurities.

(4) An outer rotor of an internal gear pump made of Cu—Ni-based sintered copper alloy having a component composition of 12 to 50% by mass of Ni, 5 to 20% by mass of Sn, 5 to 20% by mass of Zn, 0.5 to 5% by mass of C, 0.1 to 0.9% by mass of P, and the balance being Cu and inevitable impurities.

Hereinafter, the reason why the component composition of the sintered copper alloy forming the inner rotor and outer rotor of the internal gear pump is limited as described above will be explained.

Ni:

Ni is solid-solved into Cu to form a base material formed of a solid solution phase of Cu—Ni-based alloy or the like, and improves strength, wear resistance, and corrosion resistance of the base material. However, if the content of Ni is less than 12%, wear and corrosion resistance become insufficient. Further, if the content of Ni is over 50%, the sintering property deteriorates, resulting in decrease of strength. For this reason, it is not preferable that the content of Ni be less than 12% and over 50%. Accordingly, the content of Ni is set within the range of 12 to 50%. More preferably, the content of Ni is 15 to 30%.

Sn:

Sn is a component for improving corrosion resistance. However, if the content of Sn is less than 5%, the corrosion resistance becomes insufficient. Further, if the content of Sn is over 20%, strength decreases. For this reason, it is not preferable that the content of Sn be less than 5% and over 20%. Accordingly, the content of Sn is set within the range of 5 to 20%. More preferably, the content of Sn is 8 to 15%.

C:

C is a component for creating a lubricating property. However, if the content of C is less than 0.5%, sufficient lubricating property is not created, whereby damages easily occur. Further, if the content of C is over 5%, strength decreases. For this reason, it is not preferable that the content of C be less than 0.5% and over 5%. Accordingly, the content of C is set within the range of 0.5 to 5%. More preferably, the content of C is 1 to 3%.

Zn:

Zn is contained, if necessary, together with Ni to form a base material formed of a solid solution phase of Cu—Ni—Zn-based alloy, and further improves the strength of the base material. However, if the content of Zn is less than 5%, strength is not improved. Further, if the content of Zn is over 20%, strength becomes insufficient. For this reason, it is not preferable that the content of Zn be less than 51 and over 20%. Accordingly, the content of Zn is set within the range of 5 to 20%. More preferably, the content of Zn is 8 to 15%.

P:

P is contained, if necessary, together with Zn to improve ductility. However, if the content of P is less than 0.1%, it is not possible to obtain the sufficient ductility. Further, if the content of P is over 0.9%, ductility decreases and brittleness increases. For this reason, it is not preferable that the content of P be less than 0.1% and over 0.9%. Accordingly, the content of P is set within the range of 0.1 to 0.9%. More preferably, the content of P is 0.2 to 0.6%.

DESCRIPTION OF THE PREFERRED EMBODIMENTS

Cu—Ni alloy powder (content ratio of Ni is indicated in Table 1) having a mean particle size of 40 μm, Sn powder having a mean particle size of 20 μm, a graphite powder having a mean particle size of 10 μm, Zn powder having a mean particle size of 30 μm, and Cu—P alloy powder (similarly, content ratio of P is indicated in Table 1) having a mean particle size of 20 μm were prepared as raw powders. These raw powders were mixed so as to have the ratios as indicated in Table 1. Stearic acid of 1% is added to the mixed raw powders, and the stearic acid and the mixed raw powders were mixed for 20 minutes by a V-typed mixer. Then, the raw powders mixed with stearic acid were press-formed to be green compacts. After that, the green compacts were sintered at the temperature indicated in Table 1 under an ammonia decomposition gas atmosphere to finally perform a sizing-treatment. As a result, rotor specimens 1 to 12 according to the invention and comparative rotor specimens 1 and 2, which have a profile of 10 mm×an inner diameter of 5 mm×a height of 5 mm and made of Cu—Ni-based sintered copper alloy each having densities as indicated in Table 2, was manufactured. Furthermore, a related art rotor specimen 1 was manufactured. The related art rotor specimen 1 has a profile of 10 mm×an inner diameter of 5 mm×a height of 5 mm and is made of an iron-based sintered alloy including Fe-0.5% C-2% Cu which has been used in the related art rotor. The following corrosion resistance test was performed with the rotor specimens 1 to 12 according to the invention, the comparative rotor specimens 1 and 2, and the related art rotor specimen 1.

Corrosion Test 1

A test solution 1 formed of an organic acid mixed gasoline assumed as a pseudo-inferior gasoline was manufactured by adding 1000 ppm of a formic acid, 1000 ppm of an acetic acid, and 5000 ppm of ethanol to gasoline, and was maintained at a temperature of 60° C. The previously prepared rotor specimens 1 to 12 according to the invention, the comparative rotor specimens 1 and 2, and the related art rotor specimen 1 were immersed in the test solution 1 maintained at a temperature 60° C. for 100 hours and then pulled out. Mass variations (%) of the rotor specimens 1 to 12 according to the invention, the comparative rotor specimens 1 and 2, and the related art rotor specimen 1 between before and after of the test were obtained by the above-described test. The obtained results were indicated in Table 2. In addition, the mass of each sample before immersing and the mass of each sample dried after immersing was obtained, and the mass variations (%) were obtained by an equation, that is, Mass variation (%)=[(the mass of a sample dried after immersing)−(the mass of a sample before immersing)]/(the mass of a sample before immersing)×100.

Corrosion Test 2

A test solution 2 formed of an organic acid mixed gasoline assumed as a pseudo-inferior gasoline was manufactured by adding 1000 ppm of sulfur to gasoline, and was maintained at a temperature of 60° C. The previously prepared rotor specimens 1 to 12 according to the invention, the comparative rotor specimens 1 and 2, and the related art rotor specimen 1 were immersed in the test solution 2 held at 60° C. for 100 hours and then pulled out. Mass variations (%) of the rotor specimens 1 to 12 according to the invention, the comparative rotor specimens 1 and 2, and the related art rotor specimen 1 between before and after of the test were obtained by the above-described test. The obtained results were indicated in Table 2. In addition, the mass of each sample before immersing and the mass of each sample dried after immersing were obtained, and the mass variations (%) were obtained by an equation, that is, Mass variation (%)=[(the mass of a sample dried after immersing)−(the mass of a sample before immersing)]/(the mass of a sample before immersing)×100.

TABLE 1

| Rotor Specimen | | Mixing Composition of Raw Powder(% by mass) | | | | | | Sintering |
|---|---|---|---|---|---|---|---|---|
| | | Graphite Powder | Cu—Ni Powder | Sn Powder | Zn Powder | Cu—P Powder | Cu Powder | Temperature (° C.) |
| Present Invention | 1 | 0.6 | Cu—30% Ni: 43.3 | 6 | — | — | 50.1 | 850 |
| | 2 | 1.2 | Cu—30% Ni: 63.3 | 8 | — | — | 27.5 | 870 |
| | 3 | 1.6 | Cu—40% Ni: 60.0 | 9 | — | — | 29.4 | 890 |
| | 4 | 2 | Cu—40% Ni: 67.5 | 10 | — | — | 20.5 | 900 |

TABLE 1-continued

| Rotor Specimen | | Mixing Composition of Raw Powder(% by mass) Graphite Powder | Cu—Ni Powder | Sn Powder | Zn Powder | Cu—P Powder | Cu Powder | Sintering Temperature (° C.) |
|---|---|---|---|---|---|---|---|---|
| | 5 | 3 | Cu—40% Ni: 75.0 | 15 | — | — | 7.0 | 950 |
| | 6 | 4.5 | Cu—70% Ni: 70.0 | 19 | — | — | 6.5 | 980 |
| | 7 | 0.6 | Cu—30% Ni: 43.3 | 6 | 6 | Cu—8% P: 2.5 | 41.6 | 850 |
| | 8 | 1.2 | Cu—40% Ni: 47.5 | 8 | 7 | Cu—8% P: 2.5 | 33.8 | 870 |
| | 9 | 1.6 | Cu—40% Ni: 60.0 | 9 | 9 | Cu—8% P: 5 | 15.4 | 900 |
| | 10 | 2 | Cu—40% Ni: 67.5 | 10 | 10 | Cu—8% P: 5 | 5.5 | 920 |
| | 11 | 3 | Cu—60% Ni: 50.0 | 15 | 14 | Cu—8% P: 10 | 8.0 | 950 |
| | 12 | 4 | Cu—95% Ni: 50.5 | 17 | 17 | Cu—8% P: 10 | 1.5 | 980 |
| Comparative | 1 | 0.5 | Cu—40% Ni: 27.5 | 10 | — | — | 62.0 | 870 |
| | 2 | 1 | Cu—40% Ni: 10.0 | 4 | — | — | 85.0 | 920 |
| related art 1 | | | | | — | | | |

TABLE 2

| Rotor Specimen | | Composite Composition (% by mass) Ni | Sn | C | Zn | P | Cu | Density (g/cm3) | Mass Variation(% ) Test Solution 1 (Organic mixed Gasoline) | Test Solution 2 (Sulfur mixed Gasoline) |
|---|---|---|---|---|---|---|---|---|---|---|
| Present Invention | 1 | 13 | 6 | 0.6 | — | — | Balance | 6.7 | −0.22 | −0.16 |
| | 2 | 19 | 8 | 1.2 | — | — | Balance | 6.8 | −0.15 | −0.06 |
| | 3 | 24 | 9 | 1.6 | — | — | Balance | 6.9 | −0.06 | −0.02 |
| | 4 | 27 | 10 | 2 | — | — | Balance | 6.9 | −0.02 | −0.01 or less |
| | 5 | 30 | 15 | 3 | — | — | Balance | 6.5 | −0.03 | −0.01 |
| | 6 | 49 | 19 | 4.5 | — | — | Balance | 6.2 | −0.06 | −0.03 |
| | 7 | 13 | 6 | 0.6 | 6 | 0.2 | Balance | 6.6 | −0.14 | −0.08 |
| | 8 | 19 | 8 | 1.2 | 7 | 0.2 | Balance | 6.7 | −0.04 | −0.03 |
| | 9 | 24 | 9 | 1.6 | 9 | 0.4 | Balance | 6.9 | −0.02 | −0.01 or less |
| | 10 | 27 | 10 | 2 | 10 | 0.4 | Balance | 7.0 | −0.01 | −0.01 or less |
| | 11 | 30 | 15 | 3 | 14 | 0.8 | Balance | 6.5 | −0.02 | −0.02 |
| | 12 | 48 | 17 | 4 | 17 | 0.8 | Balance | 6.0 | −0.08 | −0.03 |
| Comparative | 1 | 11* | 10 | 0.5 | — | — | Balance | 6.5 | −3.33 | −0.96 |
| | 2 | 27 | 4* | 1 | — | — | Balance | 6.7 | −4.23 | −1.11 |
| Related art 1 | | Fe—0.5% C—2% Cu | | | | | | 6.9 | −6.63 | −1.33 |

*means a value out of the range of the present invention

It can be understood from the results shown in Tables 1 and 2 that all of the rotor specimens 1 to 12 according to the invention, which are made of Cu—Ni-based sintered copper alloy, have excellent corrosion resistance to the organic acid mixed gasoline and the sulfur mixed gasoline assumed as a pseudo-inferior gasoline, as compared to the related art rotor specimen 1 made of the iron-based sintered alloy.

Since the inner rotor and outer rotor according to the invention have both the corrosion resistance to sulfur contained in the inferior gasoline or a compound thereof and the corrosion resistance to the organic acid such as a formic acid or acetic acid, it is possible to obtain an internal gear pump having longer operating life by incorporating the inner rotor and outer rotor according to the invention. Accordingly, the inner rotor and outer rotor according to the invention are especially advantageous for the automobile industry.

What is claimed is:

1. An inner rotor of an internal gear pump comprising a Cu-Ni-based sintered copper alloy having a component composition of 12 to 50 % by mass of Ni, 5 to 20 % by mass of Sn, 0.5 to 5 % by mass of C, and a balance being Cu and inevitable impurities.

2. An outer rotor of an internal gear pump comprising a Cu-Ni-based sintered copper alloy having a component composition of 12 to 50 % by mass of Ni, 5 to 20 % by mass of Sn, 0.5 to 5 % by mass of C, and a balance being Cu and inevitable impurities.

3. An inner rotor of an internal gear pump of claim 1 wherein the Cu-Ni based sintered copper alloy further include 5 to 20 % by mass of Zn, and 0.1 to 0.9 % by mass of P.

4. An outer rotor of an internal gear pump of claim 2 wherein the Cu-Ni-based sintered copper alloy further include 5 to 20 % by mass of Zn, and 0.1 to 0.9 % mass of P.

* * * * *